US006836534B2

(12) United States Patent
Carmena

(10) Patent No.: US 6,836,534 B2
(45) Date of Patent: Dec. 28, 2004

(54) HIGH VOLTAGE TRANSFORMER

(75) Inventor: Ángel Díaz Carmena, Madrid (ES)

(73) Assignee: Sociedad Espanola de Electromedicina y Calidad, S.A., Madrid (ES)

( * ) Notice: Subject to any disclaimer, the term of this patent is extended or adjusted under 35 U.S.C. 154(b) by 0 days.

(21) Appl. No.: 10/617,440

(22) Filed: Jul. 3, 2003

(65) Prior Publication Data

US 2004/0061588 A1 Apr. 1, 2004

Related U.S. Application Data

(63) Continuation of application No. PCT/ES02/00009, filed on Jan. 10, 2002.

(30) Foreign Application Priority Data

Jan. 10, 2001 (ES) ..... 200100055

(51) Int. Cl.[7] ..... H05G 1/32
(52) U.S. Cl. ..... 378/111; 378/112; 363/59
(58) Field of Search ..... 378/111, 112, 378/113, 114, 109, 101; 363/59, 15, 61

(56) References Cited

U.S. PATENT DOCUMENTS 4,333,011 A * 6/1982 Mester ..... 378/110
4,439,869 A * 3/1984 Hermeyer et al. ..... 378/113
4,443,843 A 4/1984 Ikeda et al.
4,601,051 A * 7/1986 Santurtun et al. ..... 378/118
4,920,554 A 4/1990 Gabbay et al.
5,090,048 A 2/1992 Blake
5,123,038 A * 6/1992 Negle et al. ..... 378/101
5,231,564 A * 7/1993 Pellegrino et al. ..... 363/61
5,257,304 A * 10/1993 Sireul et al. ..... 378/101
5,335,161 A * 8/1994 Pellegrino et al. ..... 363/61
5,497,409 A 3/1996 Jedlitschka et al.
5,847,518 A * 12/1998 Ishiwaki ..... 315/276
6,642,829 B1 * 11/2003 Carmena ..... 336/182

FOREIGN PATENT DOCUMENTS

EP 531189 A1 3/1993

* cited by examiner

*Primary Examiner*—David V. Bruce
*Assistant Examiner*—Irakli Kiknadze
(74) *Attorney, Agent, or Firm*—Klauber & Jackson

(57) ABSTRACT

The conventional high voltage elements (1, 8) constituting it are located in such a way that the ground level (2) is situated in the central zone and from this zone the negative potential progressively increases towards one of the ends (3) while the positive potential progressively increases towards the opposite end (4). It is preferably applicable to radiogenic vessels (9), which also present the particular feature that all the elements constituting them present a voltage distribution identical to that of the transformer, in order to establish equipotential lines that do not require the incorporation of insulating elements, and which also enable the elements to be positioned very close to each other in such a way that the volume, its weight and its cost are considerably reduced.

10 Claims, 3 Drawing Sheets

HIGH VOLTAGE TRANSFORMER

This Application is a continuation of PCT/ES02/00009 filed Jan. 10, 2002.

OBJECT OF THE INVENTION

As stated in the title of this description, this invention refers to a high voltage transformer which presents a novel distribution of the elements determining a configuration of small size, with less weight and lower price.

These characteristics of the high voltage transformer enable it to be combined into electronic equipment, in such a way that they have a smaller volume and lower price and cost. In order to achieve this, the concept of the novel distribution of the elements constituting the transformer is also adopted in the configuration or distribution of the elements constituting the rest of the electronic equipment.

The invention is preferably applicable to radiogenic vessels used for taking radiographs, but it can evidently also be used in any piece of electronic equipment requiring the use of a high voltage transformer.

BACKGROUND OF THE INVENTION

Conventional X-ray rooms basically consist of an X-ray tube, which is powered by a high voltage transformer. This high voltage transformer is normally located several metres away (between 4 and 30 metres) from the X-ray tube. The connection between the two is done with special high voltage cables, which have the disadvantage of being expensive.

Owing to their bulkiness, the high voltage cables also display the added inconvenience that they hinder the mobility of the X-ray tube for positioning the beam in the right place.

With the aim of simplifying the installation, cutting the cost and reducing the overall volume of the equipment, the use of radiogenic vessels is known, which consist of a device combining the X-ray tube and the high voltage transformer into a single receptacle, making it unnecessary to use high voltage cables.

The greatest difficulty in the design of a radiogenic vessel consists of achieving the necessary electrical insulation among the different elements it comprises (transformers, high voltage connectors, rectifiers, filters, voltage dividers, shunts, dischargers, cabling, etc.). The insulation can be done in three different ways:

A) Vacuum filling in a dry environment of the whole of the interior of the vessel with an insulating liquid or gaseous fluid, normally silicone oil or mineral oil on account of their ease of handling and low cost.

B) Using solid insulating pieces such as plastics, glass, porcelains, resins, etc.

C) Encapsulating the entire unit with high voltage insulating resins or silicones under vacuum.

In any case, in order to achieve a good insulation, the different components or elements need to be kept separated by a certain distance as a function of the voltage applied between the components.

Evidently, the components of the radiogenic vessel have various geometric shapes and different sizes, and it is absolutely necessary to maintain the minimum insulating distance between the points with the greatest voltage. In the majority of cases this implies that the insulation distance between less critical points is excessive. Consequently, the total volume of the radiogenic vessel is greater than that strictly necessary. In addition, the excess of volume has to be occupied with insulating material, which considerably increases the weight and, above all, the cost of the vessel.

In order to mitigate this problem, the use of high voltage transformers with high frequency technology is known in the state of the art, but nevertheless, although they reduce the problem, vessels continue to have a larger volume, weight and cost than what is necessary.

DESCRIPTION OF THE INVENTION

To solve the above-mentioned drawbacks, the invention has developed a new high voltage transformer characterized in that the conventional high voltage elements constituting it are located in such a way that the 0 volts level, or ground level, is located in the central zone, and from this zone the negative potential progressively increases towards one of the ends, and moreover the positive potential progressively increases towards the opposite end.

In this manner, the elements with lowest voltage are closest together and those with greatest voltage are more separated, in such a way that this structure has the major advantage that the elements do not need to be insulated from each other and the distance that they have to be separated by is considerably reduced, and as a consequence their volume, weight and cost are also reduced.

With respect to the conventional low voltage elements contained in the transformer, these are separated from the high voltage elements by insulating means.

In an embodiment of the invention, the insulating means for separation between the high and low voltage elements consist of an insulating partition.

In addition, the invention is also characterized in that the transformer that is described is combined into a piece of electronic equipment of the type that requires a high voltage power supply, in such a way that both the transformer and the rest of the components making up the electronic equipment are arranged in such a way that the ground level is located in the central zone and from there the negative potential progressively increases towards one of the ends while the positive potential progressively increases towards the opposite end, thus establishing equipotential voltages at the same distance from the ground level between the different elements constituting the electronic equipment. For this reason, no insulation is needed between them and therefore the distance that they have to be separated by becomes considerably reduced. Moreover, the elements occupying the same potential zone have absolutely no influence on the parasite capacity and therefore there are no limitations neither on their proximity nor on the facing surface between them.

Consequently, by designing the elements in such a way that their voltage levels match the potential zone they occupy, this permits the elements to be brought up to each other until they almost come in contact.

This configuration facilitates the assembly of the elements, which in turn reduces the assembly work at the same time as having greater ease of location and handling due to having a smaller volume and weight.

Moreover, it presents a higher functioning reliability and a lower reduction of the electrical stress in the high voltage insulators, consisting of the insulating fluid filling the interior of the radiogenic vessel.

In one embodiment of the invention, the progressive increment in voltage towards the ends is linear.

In order to facilitate a better understanding of this descriptive report, and forming an integral part thereof, included below is a series of figures in which, by way of illustration only and not to be regarded as restrictive, the object of the invention has been represented.

DESCRIPTION OF A PREFERRED EMBODIMENT OF THE INVENTION

Figure 1:
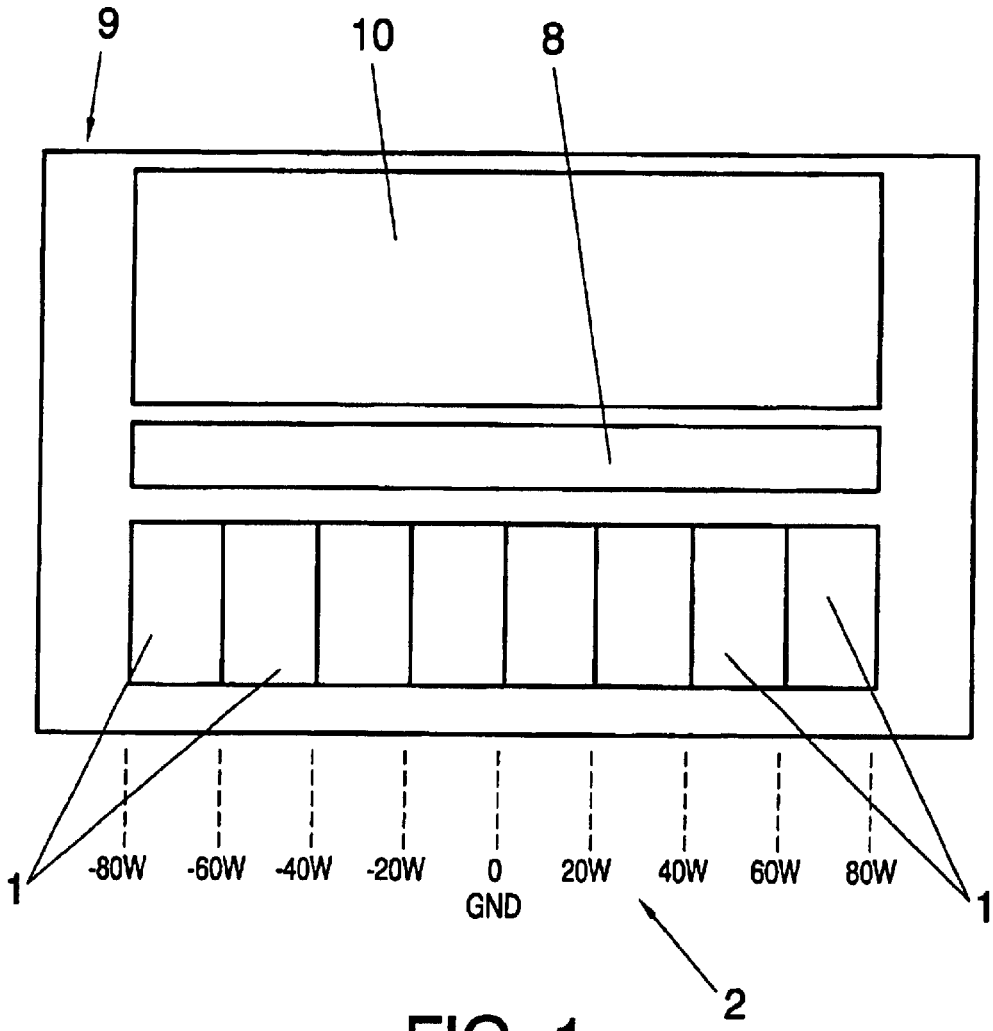
FIG. 1 shows a schematic view in elevation of the interior of a radiogenic vessel in accordance with a possible example of producing the invention.
Figure 2:
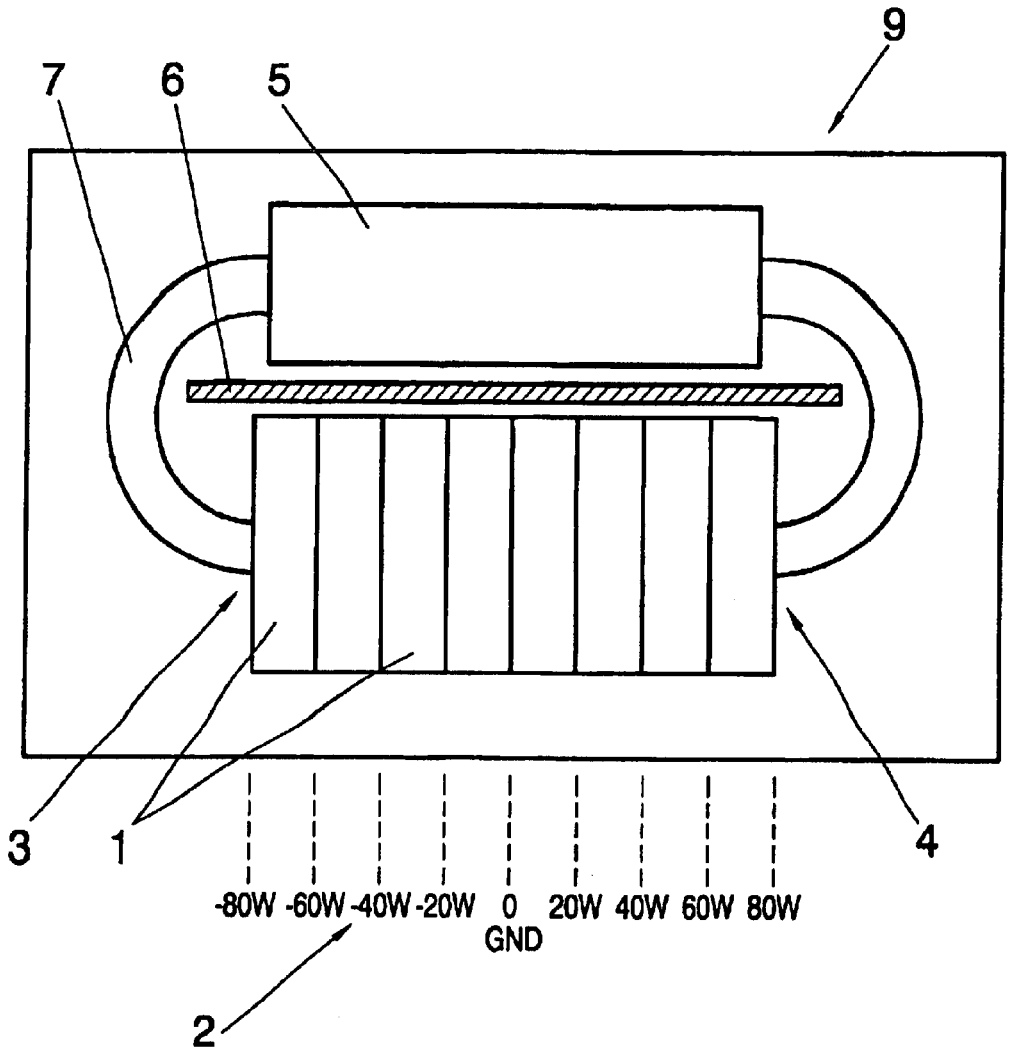
FIG. 2 shows a schematic view of the lower part in plan view of the interior of the radiogenic vessel of the previous figure.
Figure 3:
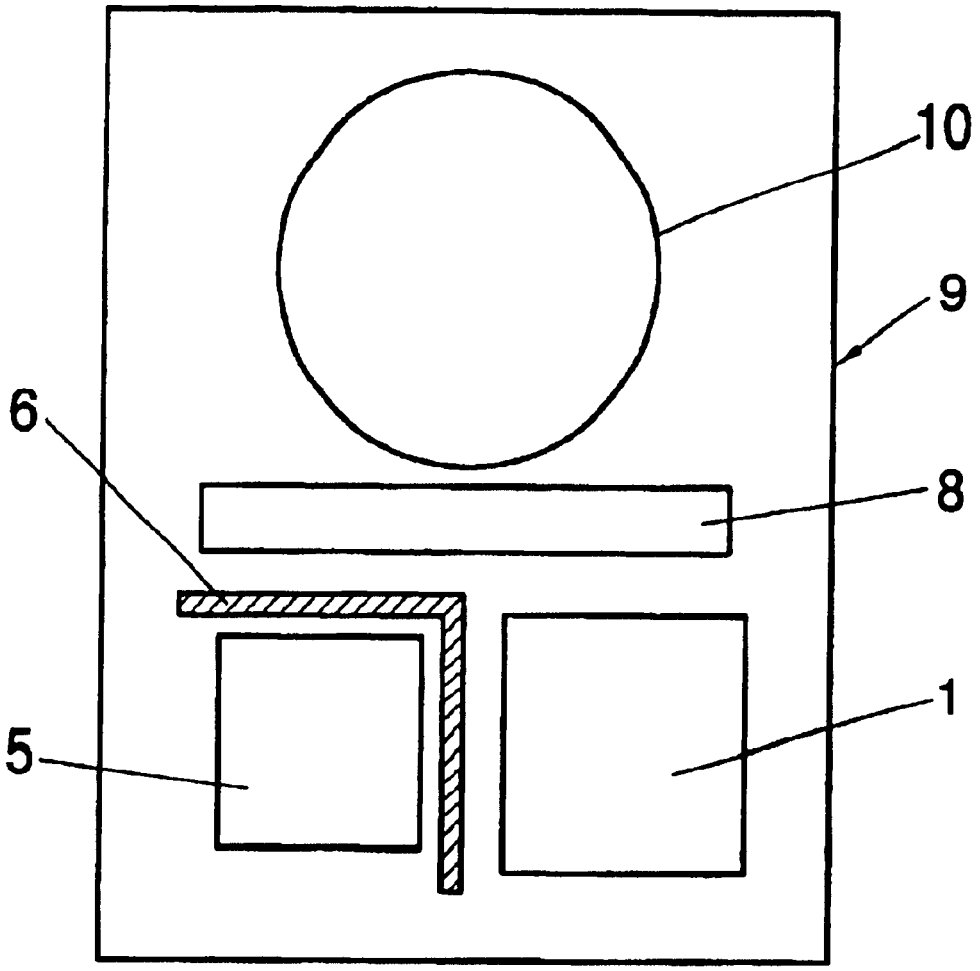
FIG. 3 shows a schematic view of the interior of the side of the vessel represented in the above figures.

Given below is a description of the invention based on the figures mentioned above.

The transformer of the invention presents a very particular configuration consisting of the secondary windings 1 being arranged in such a way that the 0 volts level, or ground level 2, is located in the middle zone of the winding, and from this zone the negative potential increases linearly towards a first end 3, and the positive potential also increases linearly towards a second end 4.

In the example of embodiment, the transformer has eight secondaries and a voltage of −80 kV in the first end 3 and +80 kV in the second end 4 said voltages linearly increasing from level 0 up to the ends, as already mentioned.

The rest of the high voltage elements constituting the transformer, such as the rectifier, filter and resistive divider, all of them encompassed in a block referenced with number 8, present an identical arrangement to that intended for the secondaries of the transformer, in such a way that equipotential lines are established between the secondaries 1 and the block 8, thus enabling the separation distance between them to be reduced to the minimum.

With regard to the low voltage components of the transformer, basically consisting of its primary 5, it can be stated that these are kept separate from the high voltage part by means of an insulating partition 6, which in the embodiment example presents an L-shaped configuration in such a way that it is kept perfectly insulated both from the secondaries 1 and from the block 8 (high voltage).

The low voltage elements (5) are arranged on a first branch of a magnetic core (7) and the secondary high voltage winding (1) is arranged on a second branch of the magnetic core (7).

In the embodiment example, the transformer forms part of a radiogenic vessel 9 which, apart from the high voltage transformer, basically includes an X-ray tube 10, arranged in a manner identical to that described for the block 8, and the different secondaries 1 of the transformer, in other words, its central part is located in correspondence with the 0 volts level 2 and the positive voltages increase linearly towards the end 4 and the negative ones towards the end 3, in such way that when equipotential levels are established there is no need to insulate them, and therefore the X-ray tube 10 can be brought up until it almost comes into contact with the block 8 or with the secondaries 1. This arrangement has absolutely no influence on the parasite capacity and therefore there are no limitations neither on their proximity nor on the facing surface between them. This structure therefore considerably reduces the volume.

Apart from the insulation 6, the vessel 1 is conventionally filled with an insulating fluid, and, as it has less volume, it requires the use of a smaller quantity of that insulating fluid.

What is claimed is:

1. A high voltage transformer, having high voltage elements (1, 8) arranged so that a 0 Volt level or ground level (2) is situated in a middle zone of a secondary high voltage winding (1);

a negative potential progressively increasing from said ground level (2) towards a first end (3);

a positive potential progressively increasing from said ground level (2) towards a second end (4);

so as to establish equipotential voltages in elements at a same distance from the ground level (2), the high voltage transformer being characterized in that it comprises low voltage elements (5) on a first branch of a magnetic core (7);

said secondary high voltage winding (1) on a second branch of the magnetic core (7).

2. A high voltage transformer according to claim 1, characterized in that low voltage elements (5) are separated from the high voltage elements (1, 8) by insulating means (6).

3. A high voltage transformer according to claim 2, characterized in that the insulating means separating the high voltage elements (1, 8) from low voltage (5) elements comprises an insulating partition (6).

4. A high voltage transformer according to any of claims 1–3, characterized in that the progressive increase in potential towards the ends (3, 4) is linear.

5. A radiogenic vessel (9) characterized in that it comprises a high voltage transformer according to claim 4;

an X-ray tube (10)

arranged so that a 0 Volt level or ground level is situated in a middle zone of the X-ray tube (10) in correspondence with the 0 Volt level or ground level (2) situated in a middle zone of the secondary high voltage winding (1);

a negative potential progressively increasing from said ground level in correspondence with the first end (3);

a positive potential progressively increasing from said ground level in correspondence with the second end (4);

so as to establish equipotential voltages in elements at a same distance from the ground level.

6. A radiogenic vessel (9) characterized in that it comprises a high voltage transformer according to any of claims 1–3;

an X-ray tube (10)

arranged so that a 0 Volt level or ground level is situated in a middle zone of the X-ray tube (10) in correspondence with the 0 Volt level or ground level (2) situated in a middle zone of the secondary high voltage winding (1);

a negative potential progressively increasing from said ground level in correspondence with the first end (3);

a positive potential progressively increasing from said ground level in correspondence with the second end (4);

so as to establish equipotential voltages in elements at a same distance from the ground level.

7. A piece of electronic equipment characterized in that it comprises a high voltage transformer, having high voltage elements arranged so that a 0 Volt level or ground level is situated in a middle zone of a secondary high voltage winding;

a negative potential progressively increasing from said ground level towards a first end;

a positive potential progressively increasing from said ground level towards a second end;

so as to establish equipotential voltages in elements at a same distance from the ground level, the high voltage transformer being characterized in that it comprises low voltage elements on a first branch of a magnetic core;

said secondary high voltage winding on a second branch of the magnetic core.

8. A piece of electronic equipment according to claim 7, characterized in that low voltage elements of the high voltage transformer are separated from the high voltage elements by insulating means.

9. A piece of electronic equipment according to claim 8, characterized in that the insulating means of the high voltage transformer, separating the high voltage elements from low voltage elements comprising an insulating partition.

10. A piece of electronic equipment according to either of claim 7, or 8, characterized in that progressive increase in potential towards the ends in the high voltage transformer is linear.

* * * * *